United States Patent [19]

Leibee et al.

[11] Patent Number: 4,605,079

[45] Date of Patent: Aug. 12, 1986

[54] DRILL BIT

[75] Inventors: Donald L. Leibee; Owen K. Crist, both of Bedford, Pa.

[73] Assignee: The Marmon Group, Chicago, Ill.

[21] Appl. No.: 746,804

[22] Filed: Jun. 20, 1985

[51] Int. Cl.[4] ..... E21B 10/36

[52] U.S. Cl. ..... 175/410; 175/393; 175/418

[58] Field of Search ..... 175/410, 415, 417, 418, 175/320, 393; 403/327, 328, 378, 108

[56] References Cited

U.S. PATENT DOCUMENTS

| | | | |
|---|---|---|---|
| 2,595,962 | 5/1952 | Letts | 403/328 |
| 3,980,805 | 9/1976 | Lipari | 403/378 |
| 4,183,691 | 1/1980 | Van Melle | 403/378 |
| 4,330,044 | 5/1982 | Orr et al. | 175/410 |
| 4,368,789 | 1/1983 | Orr et al. | 175/418 |

FOREIGN PATENT DOCUMENTS

| | | | |
|---|---|---|---|
| 905126 | 1/1954 | Fed. Rep. of Germany | 175/410 |

*Primary Examiner*—James A. Leppink
*Assistant Examiner*—Hoang C. Dang
*Attorney, Agent, or Firm*—Kline, Rommel & Colbert

[57] ABSTRACT

A drill bit for use in combination with a through-the-steel drill stem, the drill bit including an elongated body portion having a bore through which cuttings may be removed through the drill stem, a web for receiving a drill tip, and a sleeve attached about the body portion thereof, the web thereof having axially extending faces coutoured from the periphery of the body portion toward the axis thereof, and the sleeve extending from the body portion and in spaced apart axial relation to the contoured faces of the web in a manner to define drill cut receiving ports opening upwardly to the drill tip and downwardly to the bore of the body portion. The drill bit may be provided with a male keeper or retainer to mate with a complementary female receptor of the drill stem for interconnection of the drill bit to the drill stem.

21 Claims, 9 Drawing Figures

Fig. 5.
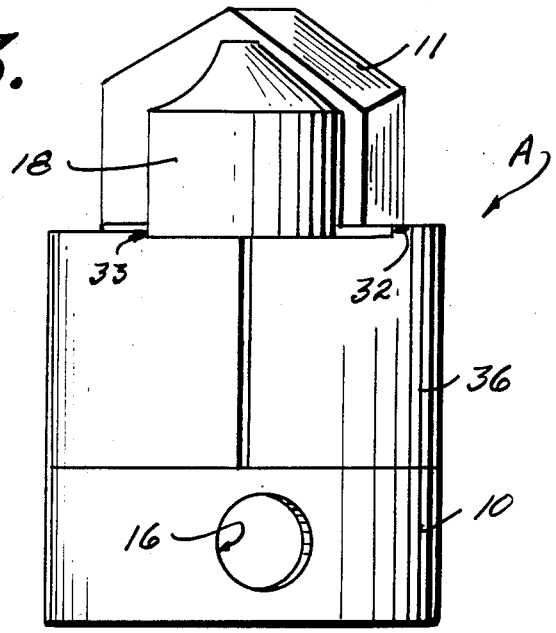
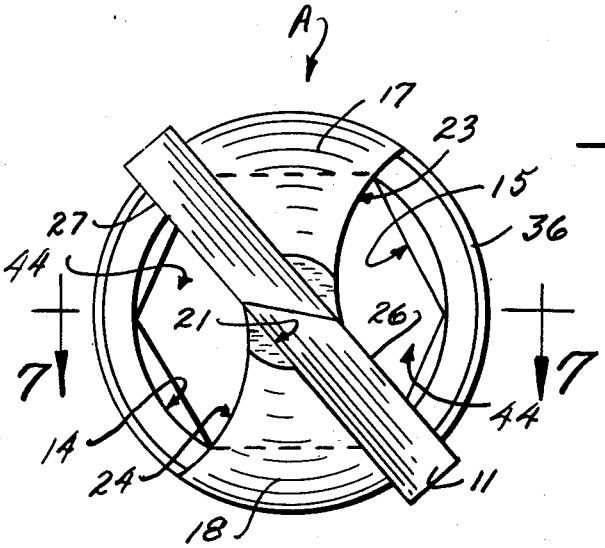
Fig. 6.
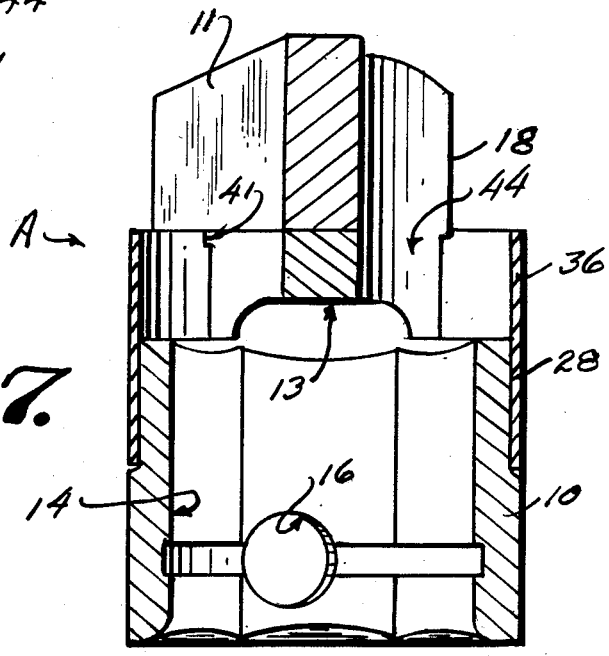
Fig. 7.

DRILL BIT

BRIEF BACKGROUND, FIELD AND OBJECTIVES OF THE INVENTION

This invention relates to improvements in drill bits for through-the-steel drill stems.

The invention was primarily developed in connection with mine roof drilling and it is thus described herein. However, it will be readily appreciated that our improved drill bit may be used with equal facility for other drilling operations, and description of the same in relation to mine roof drilling is not to be construed as a limitation on the scope of the invention.

In mining operations, such as coal mining, it has become a widely accepted practice to support the mine roof by means of roof bolts as embedded within spaced apart holes drilled in the mine roof. Roof bolts serve to pin pieces of loose material to solid rock above, reinforce areas of the underground arch, prevent sheer movement of rock strata, and form a solid self-supporting beam of several weak strata. With each advance of the mine face additional roof bolts are required and it thus follows that there will be an extremely large number of holes drilled into the mine roof for receiving roof bolts.

It is quite naturally desirable to prevent fine respirable dust from being suspended in the air the miners must breathe. As is obvious, drilling in a mine roof is a setting conducive to dispersion of drill dust within the mine. Through-the-stem drilling is thus usually used for drilling in mines. That is, use of a hollow drill stem in which a partial vacuum is created for drawing drill cuttings thereinto and thence to a collector. Drill bits for through-the-steel drill stems are provided with drill ports through which the drill cuttings may be drawn into the through-the-steel drill stem.

Others have previously proposed various types of drill bits for use with through-the-steel drill stems. By way of examples, as shown in U.S. Pat. Nos. 3,187,825; 3,434,553; 3,434,554; 3,613,807; 4,313,506; 4,330,044; and 4,492,278.

As described in U.S. Pat. No. 4,313,506, those drill bits having ports on the sides thereof through which drill cuttings may be exhausted are necessarily elongate and also generally include work surfaces which grind the drill cuttings to a relatively fine dust-like consistency. It is apparent that the more finely divided the drill cuttings, the greater the possibility of suspension of the same in the air. Also, grinding of the drill cuttings causes the drill bit to become very hot, thus shortening its useful life.

Drill bits having side ports are also deficient in that, during the first inch or so of drilling, and until the side ports enter the drilled hole, the drill cuttings will be spewed directly into the mine.

Further, in use of drill bits having side ports, the finely divided drill dust is necessarily drawn down along the sides of the drilled holes to the side ports, with the result that at least some of such finely divided drill dust will be left clinging to the sides of the drilled hole. Drill dust as collected on the walls of the drilled hole is likely to cause slippage of a mine roof bolt of the expansion type and, where resin is used, into which the mine roof bolt is embedded, results in incomplete adherence of the resin to the side walls of the drilled holes.

We recognize that others have previously provided drill bits having drill cut receiving openings that open upwardly to the drill tip. For instance, as shown in U.S. Pat. No. 4,330,044. Such drill cut receiving openings have usually been provided either by drilling holes through the top of the bit or by use of a hollow bit having a drill tip supported thereacross. As to those having holes drilled through the top of the bit, the same do not open along a sufficient area of the cutting edges of the drill tip for efficient withdrawal of the drill cuttings directly therethrough. As to those which are hollow, the side walls thereof must necessarily be fairly thick in order to support the drill tip without fracturing, the thicker side walls reducing the area of the drill ports.

In the present invention, the body of the drill bit is unitarily formed for supporting the drill tip in a manner such that the forces of drilling torque are distributed throughout the body portion thereof instead of only at the upper extremities of the drill ports as in the drill bit of U.S. Pat. No. 4,330,044. In our drill bit a sleeve is provided about the body portion thereof to define the outer reaches of the dust collection ports.

It is thus an object of this invention to provide a drill bit having drill cut receiving ports opening directly to and along the cutting edge of the drill tip so that drill cuttings may be directly drawn thereinto without finely dividing the same and in which the size of such ports is not proscribed by side walls that are necessarily thick in order that they may support a drill tip against drilling torque.

Through-the-steel drill stems now in general use include a male keeper designed to mate with a female receptacle of the drill bit for attachment of the drill bit to the drill stem.

Such keepers are generally spring loaded toward and extend into an opening as provided through the drill bit shank. As is apparent, drill dust and other debris that is usually present in a mine may collect within the drill shank opening and become impacted thereagainst during the drilling operation in such a manner as to cause depression of the keeper, in which case the drill bit may be lost up in the drill hole.

Also, the not infrequently required removal of worn bits and connection of new ones inflicts considerable wear and tear on the keeper of the drill stem, causing it to weaken, as a result of which breaking and shearing of drill stem keepers has proven to be a constant problem.

Thus, a further object of this invention is the provision of a male keeper as mounted on the drill bit and which mates with a female receptacle of the drill stem.

Other objects and advantages of the invention will become apparent from the following detailed description, taken in connection with the accompanying drawings, and in which drawings:

BRIEF DESCRIPTION OF THE DRAWINGS

FIG. 5 is a side view of the drill bit of FIG. 1 to which have been attached the drill tip of FIG. 3 and the sleeve of FIG. 4.

FIG. 6 is a top view of the drill bit of FIG. 5.

FIG. 7 is a transverse sectional view taken substantially along the line 7—7 of FIG. 6.

DETAILED DESCRIPTION

Figure 1:
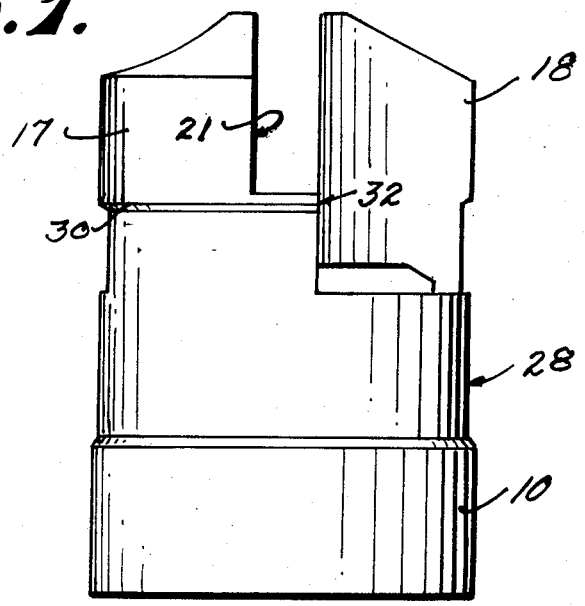
FIG. 1 is a side view of one form of our improved drill bit.
Figure 3:
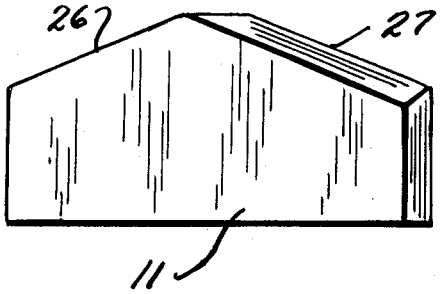
FIG. 3 is a side view of a drill tip for attachment to the drill bit of FIG. 1.
Figure 4:
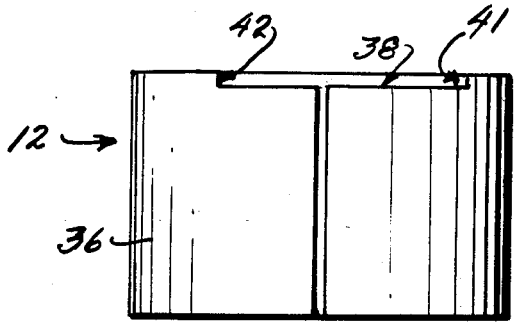
FIG. 4 is a side view of a sleeve adapted for attachment about the drill bit of FIG. 1 for defining the drill cut receiving ports thereof.
Figure 2:
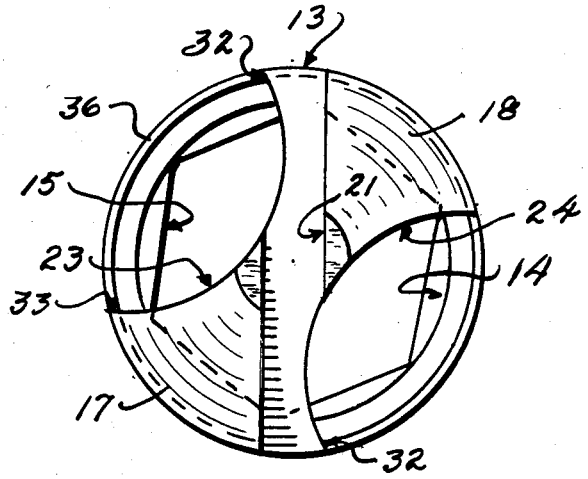
FIG. 2 is a top view of the drill bit of FIG. 1.
Figure 8:
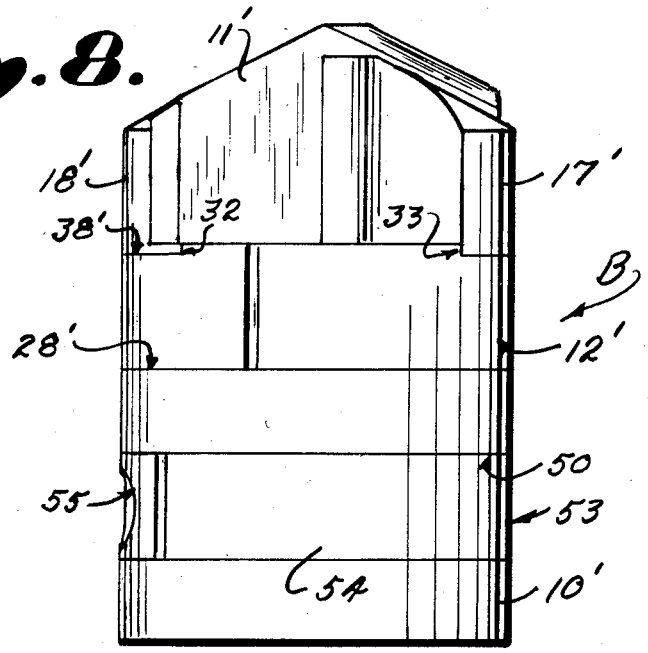
FIG. 8 is a side plan view of a modified form of the invention.
Figure 9:
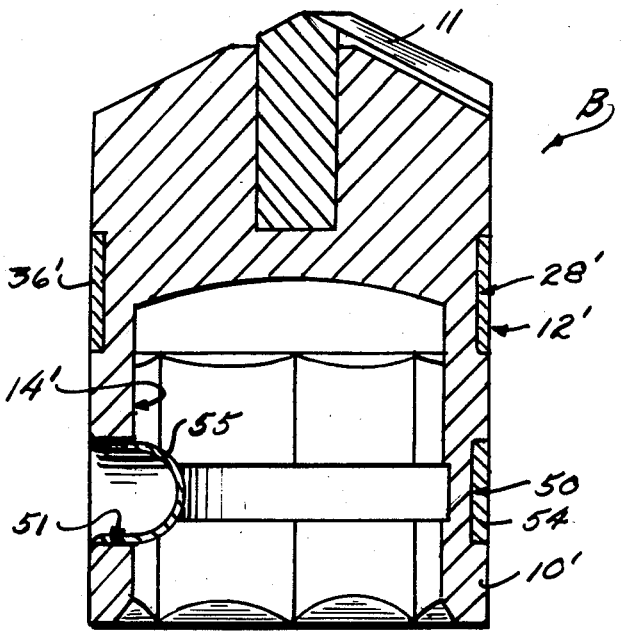
FIG. 9 is a vertical sectional view of the drill bit of FIG. 8.

In the drawings, wherein similar reference characters designate corresponding parts throughout the several views, the letter A may generally designate the drill bit as shown in FIGS. 1 through 7 and the letter B the drill bit as shown in FIGS. 8 and 9.

Drill bit A preferably comprises an elongated body portion 10, drill tip 11, and sleeve means 12.

As shown, elongated body portion 10 is of a cylindrical configuration, as is sleeve means 12. As is apparent, body portion 10 may have other than a cylindrical periphery, polygonal for instance. Sleeve means 12 may also be configured other than cylindrical.

The upper end of body portion 10 is provided with a web 13 and has an interior axial bore 14 opening to the lower or shank end thereof.

At least the lower portion of bore 14 may be of such as a hexagonal configuration defining a socket 15 within which to receive the correspondingly hexagonal end of a through-the-steel drill stem (not shown). A female receptacle 16 may be provided through body portion 10, adjacent the lower end thereof, for receiving the mating male keeper of the drill stem (not shown) whereby to attach drill bit A to a drill stem.

Web 13 extends transversely across bore 14, from side-to-side of body portion 10, and is provided with upstanding opposed crown portions 17 and 18 which define therebetween a slot 21 within which drill tip 11 may be mounted and secured such as by brazing. Opposed sides of web 13 are cut away, preferably in the nature of a hemisphere, to provide contoured faces 23 and 24 extending axially of and from the periphery of body portion 10, opening at one end thereof to bore 14. The other end of face 23 opens to cutting edge 26 of drill tip 11 and the other end of face 24 opens to cutting edge 27 of drill tip 11.

Body portion 10 is preferably provided with a recess 28 which extends peripherally thereabout, the lower end of which is disposed below lower reach of contoured faces 23 and 24 and the upper end of which extends across web 13 above the lower reaches of contoured faces 23 and 24.

Web 13 may include land portions 30 having shoulders 32 and 33 for purposes as will be subsequently described.

As thus constructed, body portion 10 may be economically manufactured. That is, absent the relatively precise angular machined surfaces as required by bits of U.S. Pat. Nos. 4,313,506 and 4,492,278 or the wave-like surfaces required by the bit of U.S. Pat. No. 4,330,044.

Sleeve means 12 preferably comprises a body portion 36, in the nature of a split-sleeve, having notched portions 38 provided at one end thereof, the ends of notched portions 38 being defined by shoulders 41 and 42.

Body portion 36 of sleeve means 12 is of a width to interfit within recess 28 of body portion 10, of a size to substantially go about recess 28 of body portion 10, and, as interfitted within recess 28, of a thickness such that the outer periphery thereof is substantially the same as the outer periphery of body portion 10.

Sleeve means 12 is mounted within recess 28 with notch portions 38 respectively receiving a land portion 30 of web 13 therewithin, and with shoulders 41 and 42 of notch portions 38 abutting against shoulders 32 and 33 of land portion 30 of web 13 as respectively received within a notch portion 38. As so mounted, sleeve means 12 extends about body portion 10 from below the lower reach of contoured faces 23 and 24 thereof and extends to above the lower reach of contoured faces 23 and 24 and in confronting relationship thereto such as to define drill ports 44 opening upwardly to each cutting edge of drill tip 11, and is maintained in such juxtaposed confronting relationship by abutment of shoulders 41 and 42 of notch portions 38 with shoulders 32 and 33 of respective land portions 30 of web 13.

If desired, sleeve means 12 may be fixedly attached about body portion 10 other than as a spring clip removably attached thereto. Of course, sleeve means 12 may comprise other than a split-sleeve. For instance, as a continuous band having a shrink fit within recess 28.

Use of a thin walled sleeve means 12 enables provision of enlarged drill cut receiving ports through which drill cuttings may be removed. This is in contradistinction to the thick wall construction dictated by U.S. Pat. No. 4,330,044 for the ports thereof.

A drill cutting may occasionally be dislodged that is of a size such that it cannot be readily received through a drill port 44. Faces 23 and 24 of drill ports 44 are contoured in the nature of a hemisphere so that, on continued rotation of the drill, an oversize piece at the entrance to a drill port will be caused to swirl between the contoured face of such drill port and into abutment with the side of the drilled hole in a manner to break up or erode the oversize drill cutting to a piece or pieces of a size to be received through a drill port.

Drill bit B is substantially similar to drill bit A except as to the means for attachment thereof to a drill stem. Thus identical reference numerals with a prime character added have been applied to the parts of drill bit B which correspond to identical parts of drill bit A.

As shown by drill bit B it is not necessary that the sleeve means of our improved drill bit be as wide as that shown for drill bit A. Thus, in drill bit B recess 28' of body portion 10' is relatively narrow and receives a correspondingly narrow sleeve means 12', the construction and function of which is otherwise identical to that as previously described in connection with sleeve means 12 of drill bit A.

Drill bit B is provided with a male keeper designed to mate with a female receptacle of the drill stem for attachment of the drill bit to a drill stem. In this regard, body portion 10' is provided with a peripheral recess 50 extending about the lowermost portion thereof below recess 28' thereof, intermedial the width of which is provided an opening 51 which extends through the bit wall to bore 14' thereof.

The male keeper of drill bit B preferably comprises a sleeve 53 having a split-sleeve body portion 54 provided with an elongated nipple or nodule 55 of a configuration such that on attachment of sleeve 53 in juxtaposed relation within recess 50, nipple 55 fits within opening 51 and extends therethrough and into bore 14' in a manner to provide a male keeper for mating with a female receptacle of the drill stem.

Sleeve 53 is preferably of the split-sleeve type so that it can be readily removed to disconnect the drill bit from the drill stem and, if the bit is to be reused, a new male keeper can be supplied.

Although not shown, it is obviously within the scope of this invention to provide body portion 10' with a single peripheral recess coexistensive from the lower reach of recess 50' to the upper reach of recess 28', and within which may be received a unitary sleeve having a nipple or nodule as previously described for providing a male keeper for attachment to a drill stem and the upper portion of which is configured to confront contoured faces 23' and 24' as previously described in connection with drill bit A.

Various changes may be made to the forms of invention as herein shown and described without departing from the spirit of the invention or the scope of the following claims.

We claim:

1. A drill bit for use in combination with a through-the-steel drill stem, said drill bit including a drill tip; an elongated body portion having a lower portion for interconnection of the drill bit to said drill stem, a head portion for receiving said drill tip, and a bore through which cuttings may be removed to said drill stem; and sleeve means attached about said body portion intermediate the lower portion and the head portion thereof, said head portion including a web extending transversely across said bore and having opposed axially extending faces contoured from the periphery of said body portion toward the axis thereof and leading from said drill tip to said bore, the upper reaches of said axially extending faces opening to the cutting edges of said drill tip and the lower reaches thereof opening to said bore, said sleeve means extending from said body portion and in opposed spaced apart axial relation to and above the lower reaches of said axially extending faces of said web whereby said axially extending faces of said web and the inner surface of said sleeve means define drill cut receiving ports opening upwardly to said drill tip and opening downwardly to said bore.

2. A drill bit as specified in claim 1 and wherein said sleeve means is of substantially the same circumference as the circumference of said body portion and extends in substantially complementary peripheral relation thereto.

3. A drill bit as specified in either of claims 1 or 2 and wherein said axially extending faces of said web are contoured as a hemisphere extending from the periphery of said body portion toward the axis thereof.

4. A drill bit as specified in claim 3 and wherein said sleeve means comprises a split-sleeve for removable attachment about said body portion.

5. A drill bit as specified in claim 4 and wherein said body portion includes a peripheral recess for receiving said sleeve means, said web includes peripheral land portions defining spaced apart shoulders of said peripheral recess, and said sleeve means includes notch means having ends for abutment with said spaced apart shoulders defined by said land portions for maintaining said sleeve means in juxtaposed relation to said axially extending faces of said web.

6. A drill bit as specified in either of claims 1 or 2 and wherein said sleeve means comprises a split-sleeve for removable attachment to said body portion.

7. A drill bit as specified in claim 6 and wherein said body portion includes a peripheral recess for receiving said sleeve means, said web includes peripheral land portions defining spaced apart shoulders of said peripheral recess, and said sleeve means includes notch means having ends for abutment with said spaced apart shoulders defined by said land portions for maintaining said sleeve means in juxtaposed relation to said axially extending faces of said web.

8. A drill bit as specified in claim 1 wherein said drill stem includes a female receptor and said drill bit includes connector means having a male keeper for mating with said female receptor of said drill stem for interconnection of said drill bit to said drill stem.

9. A drill bit as specified in claim 8 and wherein said connector means comprises a band of substantially the same circumference as the circumference of said body portion and the lower portion of said body portion includes a peripheral recess for receiving the same, an orifice being provided within said recess, said orifice extending through to said bore of said body portion, and said male keeper of said connector means comprises a nipple as provided on said band and extending through said orifice.

10. A drill bit as specified in claim 9 and wherein said band comprises a split-sleeve for removable attachment to said body portion.

11. A drill bit as specified in either of claims 8, 9, or 10 and wherein said sleeve means is of substantially the same circumference as the circumference of said body portion and extends in substantially complementary peripheral relation thereto.

12. A drill bit as specified in claim 11 and wherein said sleeve means comprises a split-sleeve for removable attachment to said body portion.

13. A drill bit as specified in claim 12 and wherein said body portion includes a peripheral recess for receiving said sleeve means, said web includes peripheral land portions defining spaced apart shoulders of said peripheral recess, and said sleeve means includes notch means having ends for abutment with said spaced apart shoulders defined by said land portions for maintaining said sleeve means in juxtaposed relation to said axially extending faces of said web.

14. A drill bit as specified in either of claims 8, 9, or 10 and wherein said axially extending faces of said web are contoured as a hemisphere from the periphery of said body portion toward the axis thereof.

15. A drill bit as specified in claim 14 and wherein said sleeve means is of substantially the same circumference as the circumference of said body portion and extends in substantially complementary peripheral relation thereto.

16. A drill bit as specified in claim 15 and wherein said sleeve means comprises a split-sleeve for removable attachment to said body portion.

17. A drill bit as specified in claim 16 and wherein said body portion includes a peripheral recess for receiving said sleeve means, said web includes peripheral land portions defining spaced apart shoulders of said peripheral recess, and said sleeve means includes notch means having ends for abutment with said spaced apart shoulders defined by said land portions for maintaining said sleeve means in juxtaposed relation to said axially extending faces of said web.

18. A drill bit for use in combination with a through-the-steel drill stem, said drill bit including a drill tip, an elongated body portion having a web for supporting said drill tip and a lower portion for interconnection of the drill bit to said drill stem, a bore through which cuttings may be removed to said drill stem, said web having contoured faces extending from said drill tip to said bore, and sleeve means mounted on said body portion in juxtaposed relation to said contoured faces and said bore to provide drill cut receiving ports through which cuttings may be removed from said drill tip to said bore thereof.

19. A drill bit as specified in claim 18 and wherein said sleeve means is of substantially the same circumference as the circumference of said body portion and extends in substantially complementary peripheral relation thereto.

20. A drill bit as specified in either of claims 18 or 19, and wherein said sleeve means comprises a split-sleeve for removable mounting on said body portion.

21. A drill bit as specified in either of claims 18 or 19, and wherein said body portion includes a peripheral recess for receiving said sleeve means and peripheral land portions defining spaced apart shoulders of said peripheral recess, and said sleeve means includes notch means having ends for abutment with said spaced apart shoulders for maintaining said sleeve means in juxtaposed relation on said body portion.

* * * * *